US007771331B2

(12) United States Patent
Lucano

(10) Patent No.: US 7,771,331 B2
(45) Date of Patent: Aug. 10, 2010

(54) PIVOTAL AXIS EXERCISE DEVICE

(76) Inventor: Michael Lucano, 2558 S. 13th St., Milwaukee, WI (US) 53215

( * ) Notice: Subject to any disclaimer, the term of this patent is extended or adjusted under 35 U.S.C. 154(b) by 47 days.

(21) Appl. No.: 12/344,482

(22) Filed: Dec. 27, 2008

(65) Prior Publication Data

US 2010/0041525 A1 Feb. 18, 2010

Related U.S. Application Data

(60) Provisional application No. 61/024,848, filed on Jan. 30, 2008.

(51) Int. Cl.
*A63B 21/05* (2006.01)
*A63B 21/02* (2006.01)

(52) U.S. Cl. ..... 482/128; 482/122; 482/126

(58) Field of Classification Search ..... 482/44–46, 482/77, 81, 82, 111, 112, 121, 122, 126–128; 463/47.2, 47.5, 47.6
See application file for complete search history.

(56) References Cited

U.S. PATENT DOCUMENTS 1,638,196 A * 8/1927 Guth ..... 482/38
3,915,451 A * 10/1975 Adams et al. ..... 482/23
4,155,547 A 5/1979 Savio et al.
4,376,533 A * 3/1983 Kolbel ..... 482/125
4,462,593 A * 7/1984 Carty, Jr. ..... 463/47.5
4,682,774 A * 7/1987 Holy ..... 463/47.5
4,934,691 A * 6/1990 Rudd ..... 482/82
5,029,847 A * 7/1991 Ross ..... 482/148
5,046,727 A * 9/1991 Wilkinson et al. ..... 482/45
5,496,240 A 3/1996 Damm
5,507,712 A * 4/1996 Chang ..... 482/126
5,601,517 A 2/1997 Haber et al.
5,643,160 A * 7/1997 Huang ..... 482/126
5,743,830 A * 4/1998 Ho ..... 482/44
5,788,617 A * 8/1998 Paris ..... 482/112
6,086,516 A 7/2000 Santos
6,406,406 B1 * 6/2002 Onorati ..... 482/44
6,497,640 B2 12/2002 Loft et al.
6,575,881 B2 6/2003 Lapcevic
6,726,603 B1 * 4/2004 Beaute et al. ..... 482/77
6,926,747 B2 * 8/2005 Udwin ..... 48/126
7,037,244 B2 5/2006 Svihra et al.
7,086,951 B2 * 8/2006 Chang ..... 463/47.5
2004/0023763 A1 2/2004 Sleiman
2009/0088304 A1 * 4/2009 Washington ..... 482/128

* cited by examiner

*Primary Examiner*—Loan Thanh
*Assistant Examiner*—Allana Lewin
(74) *Attorney, Agent, or Firm*—Absolute Technology Law Group, LLC

(57) ABSTRACT

A pivotal axis exercise device which creates opposing forces to provide muscle resistance to selected muscle groups based on a personally selected exercise regime. The device is comprised of metal housing components attached with metal loops and cable loops to provide a pivotal axis point which may be gripped and pulled to provide resistance leveraging the pivotal axis point of the device, or which may be gripped along the metal housing components to vary the exercise regimen and to provide resistance to different muscle groups.

20 Claims, 2 Drawing Sheets

PIVOTAL AXIS EXERCISE DEVICE

CLAIM OF PRIORITY

This application clams priority to U.S. Provisional Application No. 61/024,848 filed Jan. 30, 2008.

FIELD OF INVENTION

This invention relates generally to the field of portable exercise devices, and, more specifically to a device that creates opposing and resistant forces to exercise selected muscle groups based on a personally selected exercise regime.

BACKGROUND

Portable exercise devices are popular due to their reduced cost, versatility for working various muscle groups, ease of transport, and storage as compared to stationary exercise equipment.

Portable exercise devices allow users who cannot afford expensive weight-lifting and resistance equipment or do not have the space to store it to develop personalized exercise routines.

There are a number of devices known in the art which use elastic or stretchable bands, springs, spring tension, mechanical tension or means to create resistance. However, these devices are limited in their design and construction as to the amount of resistance they may provide and the specific muscle groups that they target.

It is desirable to have an apparatus which allows a user to develop a wide range of muscle groups using varying levels of resistance to develop a personalized exercise routine.

SUMMARY OF THE INVENTION

The present invention is a pivotal axis exercise device described herein which creates muscle resistance which incorporates features to provide a pivotal axis point that creates resistance to promote exercise of various muscle groups, and to provide interaction between various muscle groups (e.g., legs, arms back) in carrying out a single exercise utilizing the pivotal axis exercise device.

The pivotal exercise device disclosed herein includes a first housing component and a second housing component, each of the housing components containing a hollow rod having an attached endplate. The hollow rod encases (encloses) a cable. The cable forms a loop at one end, and has a second end which is crimped. Each of said first housing component has a first end cap and a second end cap, the second end cap having an aperture adapted to receive said hollow rod, said hollow rod adapted to move slidably through said aperture.

When each housing component is pulled, using external gripping components for leverage, a plurality of springs and a plurality of washers which are alternately spaced outside of the hollow rod and inside the housing components are compressed to create a resistant force.

The apparatus disclosed herein enables a user to develop a personalized exercise plan to develop the following muscle groups:

Back: deltoid erector spinae-spinalis; erector spinae—iliocostalis; erector spinae—longissimus; infraspinatus; interspinales; intertransversarii; levator scapulae; levatores costarum; obliquus capitis inferior; obliquus capitis superior; rectus capitus posterior major; rectos capitus posterior minor; rhomboid major; rhomboid minor; serratus posterior inferior; serratus posterior superior; capitis; splenius cervicis; supraspinatus; teres major; teres minor; transversospinalis—multifidus; transversospinalis rotatores; semispinalis; trapezius Upper Extremity Muscles: abductor digiti minimi (hand); abductor pollicis brevis; abductor pollicis loops; adductor pollicis; anconeus; articularis cubiti; biceps brachii; brachialis; brachioradialis; coracobrachialis; deltoid; extensor carpi radialis brevis; extensor carpi radialis longus; extensor carpi ulnaris; extensor digiti minimi (hand); extensor digitorum (hand): extensor indicis; extensor pollicis brevis; extensor pollicis long; flexor carpi radialis; flexor carpi ulnaris; flexor digiti minimi brevis (hand); flexor digitorum profundus; flexor diaitorum superficialis; flexor pollicis brevis; flexor pollicis longus; infraspinatus; interossei—dorsal of hand; interossei—paimar of hand; latissimus dorsi; lumbricals of hand; opponens digiti minimi (hand); opponens pollicis; palmaris brevis; palmaris longus; pectoralis major; pectoralis minor; pronator quadrates; pronator teres; serratus anterior; subscapularis; supinator; supraspinatus; teres major; teres minor; triceps Head & Neck Muscles: aryepiglotticus; auricularis; buccinator; constrictor of pharynx—inferior; constrictor of pharynx—middle; constrictor of pharynx—superior; corruaator supercilii; cricothyroid; depressor anguli oris; depressor labii inferioris; digastric; digastric anterior view); frontalis; genioglossus; geniohvoid; hvoglossus; inferior oblique; inferior rectus; intrinsic muscles of tongue; lateral cricoarytenoid; lateral pterygoid; lateral rectus; levator anguli oris; levator labii superioris; levator labii superioris; alaeque nasi; levator palpebrae superioris; levator veli palatini; longus capitis; longus colli; masseter; medial pterygoid; medial rectus; mentalist m. uvulae; mylohyoid; nasalis; oblique arytenoid; obliques capitis inferior; obliques eapitis superior; omohyoid; orbicularis oculi; orbicularis oris; palatoglossus; palatopharyngeus; platysma; posterior cricoarytenoid; procerus; rectus capitus, anterior; rectus capitus lateralis; rectos capitus posterior major; rectus capitus posterior minor; risorius; salpingopharyngeus; scalenus anterior; scalenus medius; scalenus minimus; scalenus posterior; splenius cervicis; stapedius; sternocleidomastoid; sternohyoid; stemothyroid; styloglassus; stvlohyoid; stvlohyoid (anterior view); stylopharyngeus; superior oblique; superior rectus; temporalis; temporoparietalis; tensor tympani; tensor von. Dalatini; thyro—arytenoid and vocalist thyro—epiglotticus; thyrohyoid; transverse arytenoid; zygomaticus major; zygomaticus minor Thoracic Muscles: diaphrasm; intercostals extemal; intercostals innermost; intercostals internal; levatores costarurn; pectoralis major; pectoralis minor; serrates anterior; serratus posterior inferior; serratus posterior superior; subcostalis; transversus thoracis Abdomen Muscles: diaphragm; external oblique abdominis; internal oblique abdaminis; maim psoas minor; pyramidalis; quadrates lumborum; rectos abdoniinis; transverses abdoininis Pelvic Muscles: bulbospongiosus; cremaster; dartos; deep transverse perinei; gemellus inferior; gemellus superior; gluteus maximus; gluteus medius; gluteus minimus; ishiocavernosus; levator ani—coccygeus; levator ani—iliococcygeus; pubococcygeus; levator ani—puborectalis; levator ani—pubovaginalis; intemus (A); obturator intemus (B); piriformis (A); piriformis (B); sphincter sphincter urethrae; superficial transverse perinea Lower Extremity Muscles: abductor digiti minimi (foot); abductor hallucis; adductor brevis; adductor Ilucis; adductor longus; adductor magnus; articularis genu; biceps femoris; extensor digitorumn brevis (foot); extensor digitorurn longus (foot); extensor hallucis brevis; extensor hallucis longus; flexor digiti ruinirni brevis (foot); flexor digitorun brevis; flexor digitorum longus (foot); flexor hallucis brevis; flexor hallucis longus; gastrocnemius; gemellus inferior; gemellus superior; gluteus maximus; gluteus medius; gluteus minimus; acilis; iliacus; interossei—dorsal of foot; interossei—plantar of foot; lumbricals of foot (4); obturator externus; obturator internus (A); obturator internus (B); pectinous; peroneus brevis; peroneus longus; neroneus tertius; piriformis (A); piriformis (B); plantaxis; popliteus; quadratus femoris; guadratus nlantae; rectos femoris; sartorius; semirnembranosus; semitendinosus; soleus; tensor fasciae lata; tibialas anterior; tibialis posterior; vastus intermedius; vastus lateralis; vastus medialis

GLOSSARY

Figure 1:
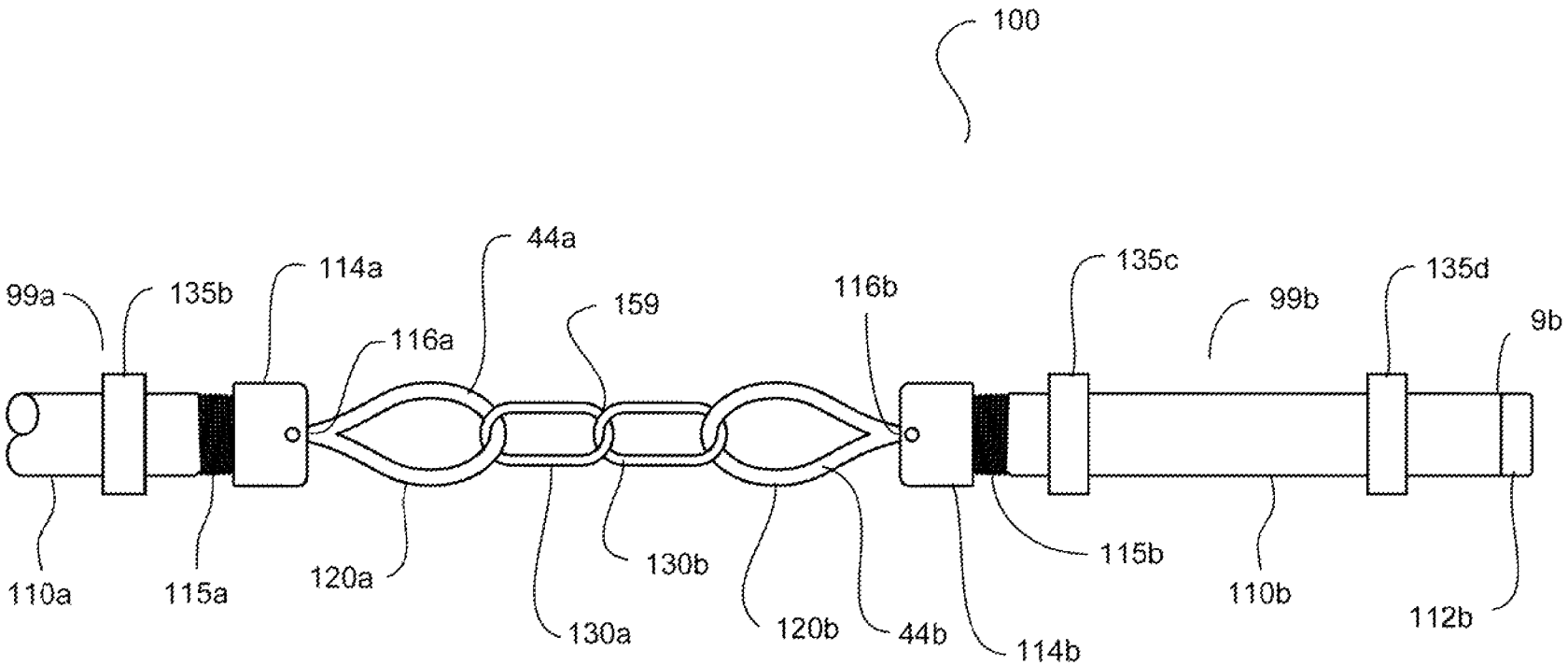
FIG. 1 illustrates a side perspective view of a pivotal axis exercise device.

As defined herein, the term "pivotal axis point" means a point where two or more structures are attached in a manner that allows them to be pivotally moved and/or pulled. A pivotal axis point may also be the point where two opposing forces are engaged by pivotal or pulling movement or pulling forces.

As defined herein, the term "spring loaded piston" means a steel rod which encases a cable and compresses one or more springs within a housing.

DETAILED DESCRIPTION OF THE EMBODIMENTS

For the purpose of promoting an understanding of the present invention, references are made in the text hereof to embodiments of a pivotal axis exercise device apparatus and system, only some of which are depicted in the figures. It should nevertheless be understood that no limitations on the scope of the invention are thereby intended. One of ordinary skill in the art will readily appreciate that modifications such as the size and shape of the components, positioning of the components relative to one another, materials from which the apparatus is made, and the inclusion of additional elements, and all equivalent relationships to those illustrated in the drawings and described in the written description do not depart from the spirit and scope of the present invention. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed system, structure, or manner.

It should be understood that all of the drawings are not necessarily to scale, emphasis instead being placed upon illustrating the principles of the invention. In addition, in the embodiments depicted herein, like reference numerals refer to identical structural elements in the various drawings.

Moreover, the term "substantially" or "approximately" as used herein may be applied to modify any quantitative representation that could permissibly vary without resulting in a change in the basic function to which it is related. For example, one embodiment of a pivotal axis exercise device is disclosed herein as including the retracting mechanism substantially within the center of the base. The retracting mechanism might permissibly be somewhat not within the center of the base and still be within the scope of the invention if its functionality is not materially altered.

FIG. 1 illustrates one embodiment of the pivotal axis exercise device 100 which includes weighted spring loaded pistons 99*a* and 99*b* attached at central point 159. Weighted spring loaded pistons include hollow tubular housing components 110*a* and 110*b*, each sealed at the outer ends of pivotal axis exercise device 9*a* and 9*b* with welded caps 112*a* and 112*b* respectively. Welded caps 112*a* and 112*b* are fixedly attached to prevent tampering and opening of tubular housing 110*a* and 110*b* and repositioning of the springs 140*a*, 140*b*, 140*c*, 140*d*, 140*e*, 140*f* and 140*g*.

As shown in FIG. 1, pivotal axis exercise device 100 utilizes a plurality of springs 140*a*, 140, 140*c*, 140*d*, 140*e*, and 140*f* and 140*g* to create resistance.

Cables 118*a* and 118*b* (contained within tubular housing 110*a* and 110*b*) are encased by hollow steel rod 77*a* and 77*b* which passes through apertures 116*a* and 116*b* of tubular housing 110*a* and 110*b* to facilitate a piston-like motion which moves cable 118*a* and 118*b*. In the embodiment shown cables 118*a* and 118*b* are each looped at one end for to form connection components 44*a* and 44*b*. In the embodiment shown, connection components 44*a* and 44*b* are coated by casing components 120*a* and 120*b* (which are coating sleeves to reduce friction and improve flexibility). In the embodiment, shown, casing components 120*a* and 120*b* may be made of rubber, plastic, pvc plastic, nylon, fabric, foam or any other material known in the art which may be adapted to form a casing or coating. Casing components 120*a* and 120*b* may be smooth or textured. Casing components 120*a* and 120*b* to reduce friction of internal steel components decrease exposure of cable to prevent fraying or rust or wear of cable 118.

In the embodiment shown, inside surfaces of detachable caps 114*a* and 114*b* (not shown) absorb pressure from springs 140*a-g* (shown infra, in FIG. 2) and maintain the spring within a relatively stationary position. In other embodiments, caps 114*a* and 114*b* may include an attachment or a stabilizing mechanism such as an aperture, and securing screw, a washer configuration commonly known in the art, an additional welded component, a crimped component, or an adhesive which further prevents disassembly.

In various embodiments, gripping components 44*a* and 44*b* may be formed of various materials and structures, including handles or structures made of metal, wood, rubber, fabric, resin, nylon, and combinations thereof.

FIG. 1 further illustrates gripping components 135*a*, 135*b*, 135*c* and 135*d* which are structural elements that surround and/or protrude from housing components 110*a* and 110*b* to facilitate gripping and provide leverage so that housing components 110*a* an 110*a* can be grasped and/or pulled by a user. In the embodiment shown, gripping rings 135*a*, 135*b* 135*c* and 135*d* may be machined or molded protrusions, water-resistant tape, foam, metal, plastic and/or welded components. Gripping rings 135*a*, 135*b*, 135*c* and 135*d* are positioned along tubular housing 110*a* and 110*b* to provide additional resistance and stability of grip to minimize hand slippage and increase potential levels of resistance. In the embodiment shown, gripping components 135*a*, 135*b*, 135*c* and 135*d* are placed equidistantly from caps 112*a*, 112*b*, 114*a* and 114*b*.

In the embodiment shown, gripping rings 135*a*, 135*b*, 135*c* and 135*d*, which are raised stationary, structural protrusions (generally fixedly attached to prevent slipping) to enable a user to more easily grasp the surface of housing 110*a* and 110, and prevent the user's hands from sliding or being repositioned along the surface of housing components 110*a* and 110*b*.

In the embodiment shown, when gripping components 135*a*, 135*b*, 135*c* and 135*d* are pulled by a user, pivotal axis exercise device 100, provides in excess up to 200 pounds of pressure to exercise various muscle groups. In the embodiment shown, hollow tubular housing 110*a* and 110*b* are made of steel.

FIG. 1 further illustrates caps 112*a* and 112*b* which are welded steel caps commonly known in the art. In various embodiments, hollow tubular housing components 110*a* and 110*b* and caps 112*a* and 112*b* may machined, attached to threaded necks or integrally molded with housing components 110*a* and 110*b*. The function of the caps 112*a* and 112*b* is to prevent inner components from being separated during impact and pressure and to prevent injury such as pinching of body parts by springs.

In the embodiment shown, detachable caps 114*a* and 114*b* are made of steel and are attached secured to threaded necks 115*a* and 115*b* respectively. Detachable caps 114*a* and 114*b* may be removed or unscrewed from hollow tubular housing 110*a* and 110*b* to enable access to inside components (described infra) for replacement, repair or upgrading. In the embodiment shown caps 114*a* and 114*b* are connected to threaded necks 99*a* and 99*b* and "tack-welded" to prevent disassembly by general users. The threading conforms to the National Pipe Thread (NPT) and (KIPS) standard, but in other embodiments removable caps 114*a* and 114*b* may be non-removable or permanently affixed.

FIG. 1 further illustrates metal loops 130*a* and 130*b* which are connectively attached (e.g. looped) through looped rubber casing components 120*a* and 120*b* to create the pivotal axis point. In the embodiment shown, metal loops 130*a* and 130*b* are carabineer devices commercially available and commonly known in the art which include a metal loop with a sprung or screwed gate. However, other embodiments may include additional types of metal loops or connective devices, or devices which are made of a different material (e.g., plastic or fiber) but which perform an equivalent function.

Figure 2:
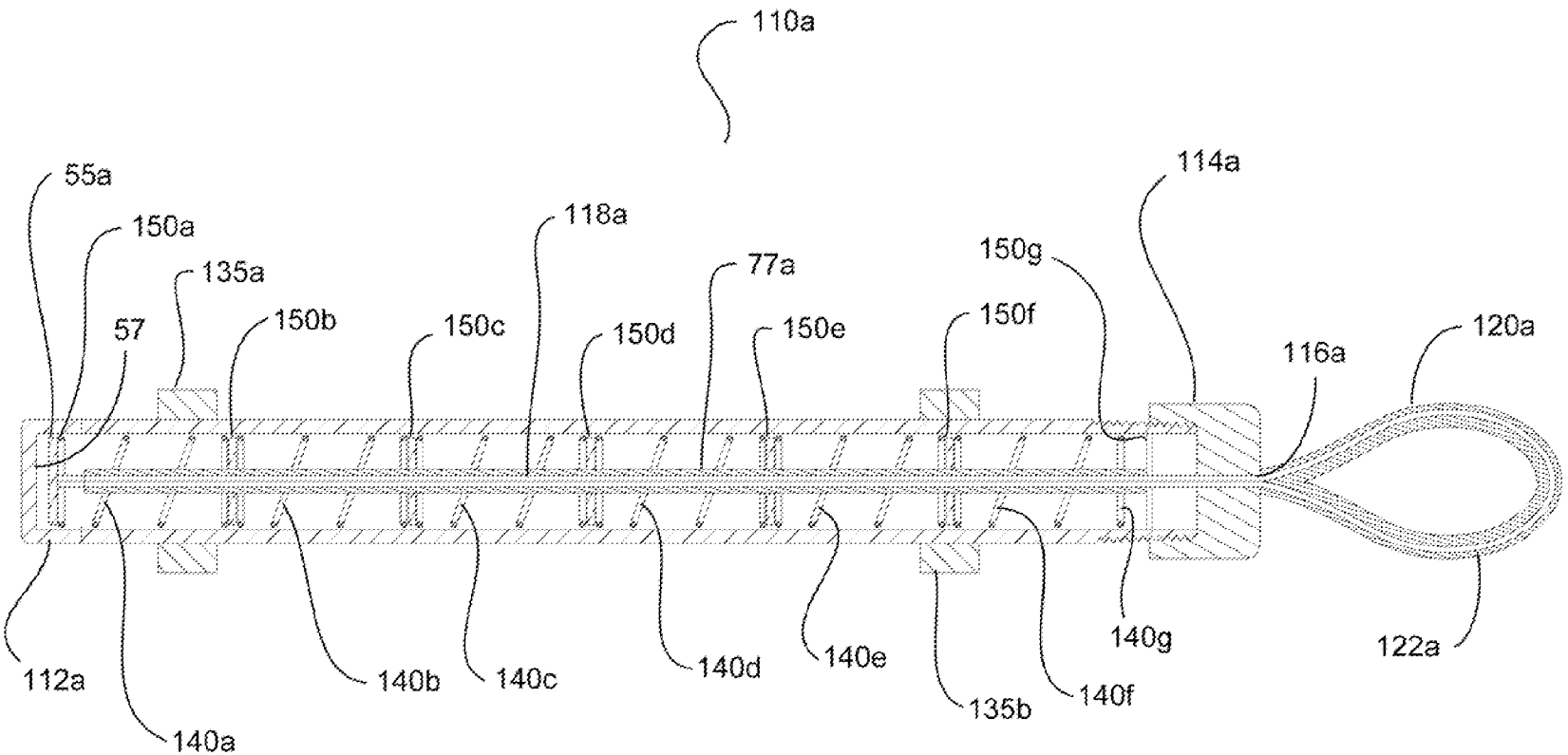
FIG. 2 is a cross-sectional of one housing component of a pivotal axis exercise device taken along the line 2-2.

FIG. 2 illustrates an internal cross-sectional view of housing component 110*a*. As shown, 118 is housed in steel tubing 220 or other steel, metal, or plastic tubing which passes through and limits range of motion of a plurality of springs 140*a*, 140*b*, 140*c*, 140*d*, 140*e*, 140*f* and 140*g*. Cable 118 further passes through apertures 116*a* and 116*b* which allows cable 118 (as shown in FIG. 2) to pass through looped rubber casing components 120*a* and 120*b* and metal casing components 122*a* and 122*b*, both of which encase cables 118*a* and 118*b*. In the embodiment shown, housing components 110*a* and 110*b* each encase seven springs but alternate embodiments may include fewer or more springs.

Further shown in FIG. 2 are metal disks 150*a*, 150*b*, 150*c*, 150*d*, 150*e*, 150*f* and 150*g*. In the embodiments shown, metal washers 150*a*, 150*b*, 150*c*, 150*d*, 150*e*, 150*f* and 150*g* have a circumference within of slightly less than that of the internal circumference of internal housing components 110*a* and 110*b*. Metal disks 150*a*, 150*b*, 150*c*, 150*d*, 150*e*, 150*f* and 150*g* are attached at its approximate center to the bottom of cable 118 by pressuring, crimping, welding, molding, brasing, and other methods commonly known in the art to maximize force absorption capability and support. In the embodiment shown, metal disks are commercially available washers with appropriate size specifications.

Further shown in FIG. 2 are metal disks 150*a*, 150*b*, 150*c*, 150*d*, 150*e*, 150*f* and 150*g* which separate springs 140*a*-*g*, and facilitate the piston-like motion of rods 77*a* and 77*b* each of which has attached endplate 55*a* and 55*b*, respectively, placed in front of the cable crimp 57 (which is a the end of cable 118*a* and 118*b* which has been crimped with a crimping tool). In the embodiments shown, when housing components 110*a* and 110*b* are pulled, a pressure is exerted on cables 118*a* and 118*b* to compress springs 140*a*-140*g* against inner surface of caps 114*a* 114*b*. This tension created by this compression will produce over 50 to 70 pounds of pressure per housing unit 110*a* and 110*b* to provide an excess of 100 to 200 pounds of pressure to various muscle groups.

What is claimed is:

1. An exercise apparatus comprised of:

a first housing component and a second housing component, each of said housing components containing a hollow rod having an attached endplate and encasing a cable;

said first housing component and said second housing component each having a first end cap and a second end cap, said first end cap having an aperture adapted to receive said hollow rod, said hollow rod adapted to move slidingly through said aperture; and said first housing component and said second housing component each further containing a plurality of springs and a plurality of washers alternately spaced outside of said hollow rod so that said springs are compressed when said hollow rod is moved slidingly through said aperture to create a resistant force.

2. The apparatus of claim 1 in which each said cable is further encased by a casing component.

3. The apparatus of claim 1 wherein each said cable is made of braided steel.

4. The apparatus of claim 1 wherein each said hollow rod is made of steel.

5. The apparatus of claim 1 which further include a plurality of metal loops which form a pivotal axis point.

6. The apparatus of claim 1 which further includes a plurality of gripping components.

7. The apparatus of claim 1 wherein said cable contained within said first housing component and said cable contained within said second housing component have at least one crimped end.

8. The apparatus of claim 1 wherein said first housing component and said second housing component have at least one threaded neck adapted to receive at least one of said end caps.

9. The apparatus of claim 1 wherein said cable within said first Housing component and said cable within said second housing component are configured to form a loop at one end which is drawn through said aperture in said first end cap.

10. An exercise apparatus comprised of:

a first housing component and a second housing component, each of said housing components containing a hollow rod having an attached endplate, said hollow rod encasing a cable having a first cable end and a second cable end, said first cable end forming a loop and said second cable end being crimped;

each of said first housing component and said second housing component having a first end cap and a second end cap, said first end cap having an aperture adapted to receive said hollow rod, said hollow rod adapted to move slidingly through said aperture; and said first housing component and said second housing component each further containing a plurality of springs and a plurality of washers alternately spaced outside of said hollow rod, so that said springs are compressed when said hollow rod is moved slidingly through said aperture to create a resistant force.

11. The apparatus of claim 10 in which said cable is further encased by a casing component.

12. The apparatus of claim 10 wherein said cable is made of braided steel.

13. The apparatus of claim 10 which further include a plurality of metal loops which form a pivotal axis point.

14. The apparatus of claim 10 which further includes a plurality of gripping components.

15. The apparatus of claim 10 wherein said cable contained within said first housing component and said cable contained within said second housing component are crimped at one end.

16. The apparatus of claim 10 wherein said first housing component and said second housing component have at least one threaded neck adapted to receive at least one of said end caps.

17. An exercise apparatus comprised of:

a first housing component and a second housing component, each of said housing components containing a hollow rod having an attached endplate, said hollow rod encasing a cable having a first cable end and a second cable end, said first cable end forming a loop and said second cable end being crimped;

each of said first housing component and said second housing component having a first end cap and a second end cap, said first end cap having an aperture adapted to receive said hollow rod, said hollow rod adapted to move slidingly through said aperture;

said first housing component and said second housing component each further containing a plurality of springs and a plurality of washers alternately spaced outside of said hollow rod, so that said springs are compressed when said hollow rod is moved slidingly through said aperture to create a resistant force;

a plurality of metal loops connecting said first housing component and said second housing component, said plurality of metal loops forming a pivotal axis point; and a plurality of gripping components.

18. The apparatus of claim 17 wherein said hollow rod and said cable are made of steel.

19. The apparatus of claim 17 wherein said cable contained within said first housing and said cable contained within said first housing component are crimped at one end.

20. The apparatus of claim 17 wherein said first housing component and said second housing component have at least one threaded neck adapted to receive at least one of said end caps.

* * * * *